United States Patent [19]

Bejak et al.

[11] Patent Number: 4,893,770

[45] Date of Patent: Jan. 16, 1990

[54] APPLIANCE AND ACCESSORIES ORGANIZER

[75] Inventors: Thomas R. Bejak, LaGrange Park; John P. Chap, Lemont, both of Ill.

[73] Assignee: Selfix, Inc., Chicago, Ill.

[21] Appl. No.: 297,556

[22] Filed: Jan. 13, 1989

[51] Int. Cl.[4] ..... D06F 75/40

[52] U.S. Cl. ..... 248/117.1; 248/302; 248/309.1

[58] Field of Search ..... 248/309.1, 314, 302, 248/213.2, 223.3, 285, 291, 294, 324, 117.1, 218.1, 175, 176, 303, 304; 211/85, 88, 89, 106, 181

[56] References Cited

U.S. PATENT DOCUMENTS

| | | | |
|---|---|---|---|
| 1,209,613 | 12/1916 | Neumaster | 248/294 |
| 2,530,027 | 11/1950 | Perrigo | 248/117.1 |
| 2,603,438 | 7/1952 | Adams | 248/117.1 |
| 3,204,903 | 9/1965 | Stoddard | 248/302 X |
| 4,101,107 | 7/1978 | Antoszewski | 248/294 X |
| 4,598,891 | 7/1986 | Hanert | 248/302 X |

OTHER PUBLICATIONS

Photograph A1: Front view of a Rubbermaid molded article.

Photograph A2: Side view of a Rubbermaid molded article.

Photocopy B1: Product card of a "Grayline Iron & Ironing Board Kaddy #440".

Photograph B2: Front view of Grayline Kaddy.

Photograph B3: Side view of Grayline Kaddy.

Photograph C1: Front perspective view of an accessory basket with a depending hook made of metal plated wire.

Photograph C2: Front view of an accessory basket with a depending hook made of metal plated wire, with a hook rotated into stowed position.

Photograph C3: Side view corresponding to photograph C2.

*Primary Examiner*—Ramon O. Ramirez

*Attorney, Agent, or Firm*—Dressler, Goldsmith, Shore, Sutker & Milnamow, Ltd.

[57] ABSTRACT

A wall mounted storage organizer has storage regions for an appliance and associated accessories, and a hanger member to retain a large article or implement associated with the appliance. The hanger member is pivotally attached to the organizer and may be rotated into a storage position to facilitate shipping, storage and merchandizing.

15 Claims, 2 Drawing Sheets

APPLIANCE AND ACCESSORIES ORGANIZER

TECHNICAL FIELD

This invention relates generally to wall-mounted organizers, and more particularly, to organizers for storage of an appliance and its related accessories.

BACKGROUND OF THE INVENTION

Wall-mounted, wire frame racks and storage devices are extremely popular with space conscious household consumers. These handy products can be hung on supports, e.g., walls and doors, in a variety of locations around the house such as in kitchens, bathrooms, garages, utility rooms, basements and closets. Typically, units of this type are made from wire which is coated with vinyl or plastic, or which is plated, to provide a durable corrosion-free surface that protects both the items being stored and the support to which the organizer is mounted from being damaged, e.g., from mars and scratches. The vinyl or plastic coating may come in a variety of colors to enhance appearance and complement the needs of decorative conscious consumers. Such devices are usually designed to be quickly and easily fastened to, or mounted on, an appropriate support surface, such as a wall or door.

One type of existing support mounted storage devices is intended to be capable of storing an electric iron and a number of accessories and miscellaneous items, such as cans or bottles, and may include a hanging member from which an ironing board is to be hung. However, known storage units of this type do not positively and securely retain an iron in position to prevent it from touching, marring, or possibly scorching the associated support or mounting surface to which the organizer is attached. Some such storage units can not be used with a number of different configurations of the irons for which they are designed.

Furthermore, although some existing devices are designed to have an ironing board hang therefrom, they do not accept certain configurations of ironing boards presently available, e.g., ironing boards with different leg configurations, such as T-shaped legs and Y-shaped legs.

In order to expand the usefulness of such organizers or storage devices, it would be desirable to incorporate therein a hanger capable of supporting large articles or implements, such as ironing boards, of various configurations. In addition, it would be useful to have a hanger that could be positioned along the frame to facilitate storage and shipping, without compromising the nestability of the unit. Furthermore, such a caddy or storage device should be able to receive various configurations of appliances for which it is designed, and should be capable of protecting the support member, e.g., the wall or door, from damage therefrom, such as from scratching or scorching.

SUMMARY OF THE INVENTION

An appliance and accessories storage caddy or organizer incorporating the present invention is mountable upon a support, such as a wall or door, and includes a frame assembly with an appliance storage region and one or more additional storage regions for miscellaneous items and/or related accessories. The organizer or storage device also includes hanger means attached to the frame assembly to support a large article associated with the appliance, such as an ironing board for an iron, and means for mounting the storage device on a support.

The appliance storage region of a storage device incorporating the present invention is configured to accept an electric iron and comprises a pair of spaced-apart L-shaped portions having upwardly extending vertical legs attached by a U-shaped and rearwardly disposed portion that prevents an iron positioned therein from touching the support or mounting surface. The storage organizer further includes a pair of generally L-shaped side frame members that are oppositely disposed and spaced apart and so configured that they generally define one or more additional storage regions on the sides of the appliance storage region and cooperate therewith to securely retain an iron within the appliance storage region.

The organizer storage regions are further defined and strengthened by frame support members having horizontal legs with offset ends for pivotal attachment of an ironing board hanging member. One or more shelf members extend between the horizontal legs to provide a supporting shelf for the organizer.

A generally U-shaped hanging member has a pair of spaced-apart J-shaped legs that are pivotally attached to horizontal legs of the frame support members. The configuration of this hanging member allows it to accept and securely retain ironing boards of varying configurations including those having either T-shaped or Y-shaped legs. Further, the pivotal feature of the hanging member allows it to be swung upward to a position to facilitate nesting of a plurality of organizers for shipment and storage.

An organizer in accordance with the present invention is mountable to a support such as a wall or door by fasteners passed through eyelets formed in pair of vertical mounting members attached to and extending between each side frame member and an additional mounting member attached to and extending between the horizontal legs of the frame support members.

Numerous other advantages and features of the present invention will become readily apparent from the following detailed description of the invention and the embodiments thereof, from the claims and from the accompanying drawings in which the details of the invention are fully and completely disclosed as part of the specification.

DETAILED DESCRIPTION OF THE PREFERRED EMBODIMENT

Figure 1:
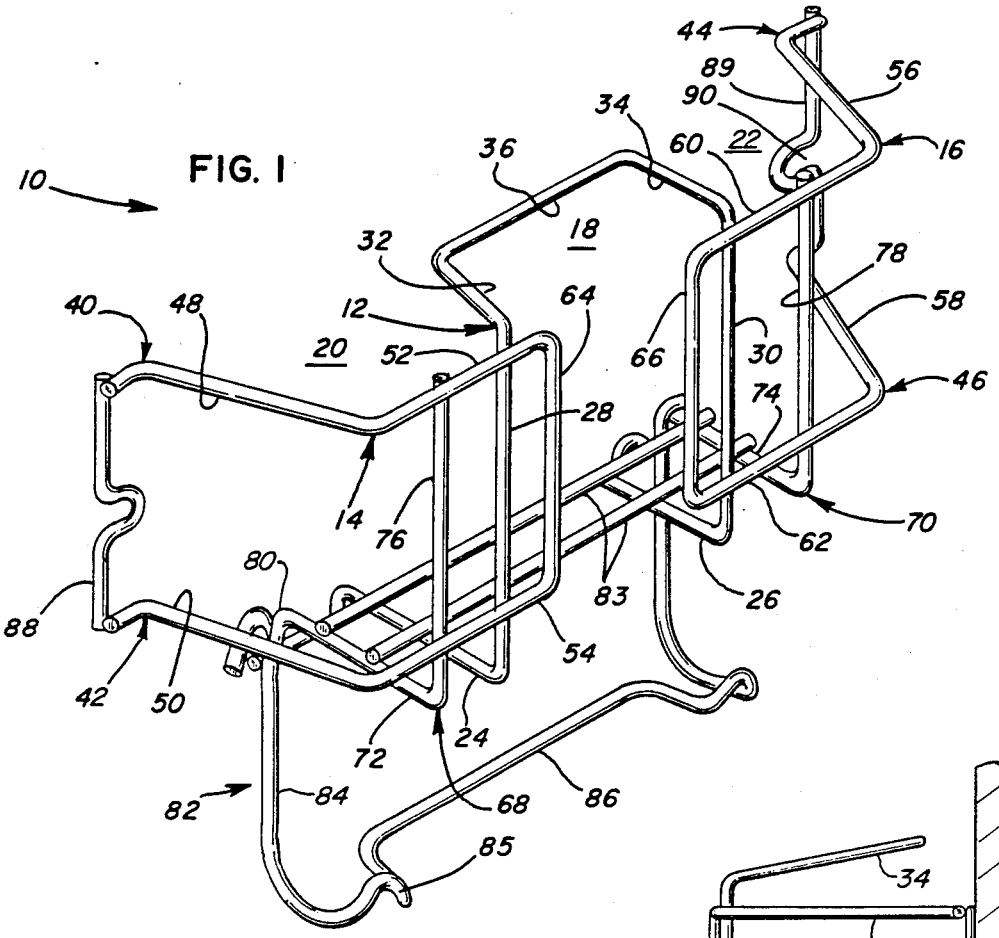
FIG. 1 is a perspective view of an appliance and accessories organizer in accordance with the present invention.
Figure 6:
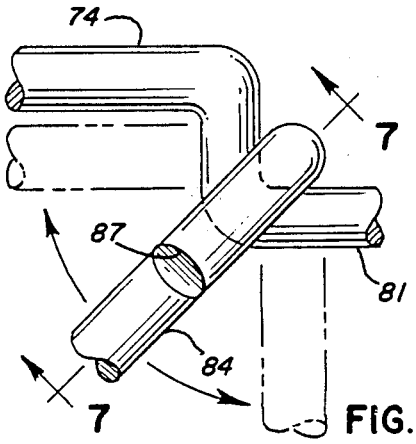
FIG. 6 is an enlarged side view of frame support member offset illustrating pivotal movement of the hanging member.
Figure 7:
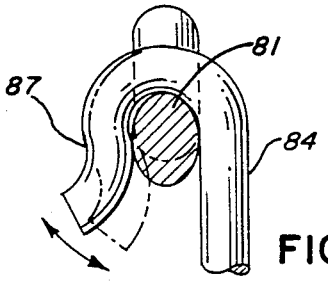
FIG. 7 is an enlarged sectional view taken along line 7—7 of FIG. 6.

While this invention is susceptible of embodiment in many different forms, there is shown in the drawings and will be described herein in detail a specific embodiment thereof with the understanding that the present disclosure is to be considered as an exemplification of the principles of the invention and is not intended to limit the invention to the specific embodiment illustrated.

Referring to the drawings, an appliance and accessories device or organizer 10 incorporating the present invention, is suitable for mounting on a surface, and is shown as constructed from appropriately shaped and interconnected plastic coated metal wire members. The plastic coating may comprise vinyl or a like material which is suitably durable and corrosion resistant, and which is typically available in a wide variety of colors for enhancing the aesthetic appeal of the organizer. The organizer 10 may be fabricated in accordance with known methods, typically comprising suitable interconnection of its various members by welding or 10 other similar method, followed by application of a plastic coating to the entire arrangement.

The storage organizer 10 includes a central appliance receiving member 12 that interconnects with left and right side frame members 14, 16, respectively, to generally define a central appliance receiving and storage region 18 and a pair of additional storage regions 20, 22 on each side thereof.

The appliance receiving member 12 is generally U-shaped and includes a pair of spaced-apart generally horizontal bottom legs 24, 26 and a pair of spaced-apart generally vertical front legs 28, 30 which extend upward from the forward ends of the bottom legs 24, 26, respectively. The upper ends of the front legs 28, 30 merge into the forward ends of generally horizontal, spaced-apart upper legs 32, 34, which together with connector leg 36, which extends between the rear ends of legs 32, 34, forms an upper U-shaped protector portion of the member 12.

Left side frame member 14 and right side frame member 16 are mirror images of each other. Left frame member 14 includes vertically spaced-apart generally horizontally extendin,g, generally L-shaped left top and bottom legs 40, 42. Right frame member 16 includes vertically spaced-apart, generally horizontally extending, generally L-shaped right top and bottom legs 44, 46. The left top and bottom legs 40, 42 each includes a left outer side portion 48, 50, respectively, that extends forwardly away from mounting surface S, each of which merge into left top and bottom front portion 52, 54, respectively. The right top and bottom legs 44, 46 each includes a right outer side portion 56, 58, respectively that extends forwardly away from mounting surface S, each of which merge into right top and bottom front portion 60, 62, respectively.

The left top and bottom front portions 52, 54 of the left top and bottom legs 40, 42, extend past the front leg 28 of the receiving member 12 and terminate in a retaining member 64 that extends vertically therebetween. The right top and bottom front portions 60, 62 of the right top and bottom legs 44, 46, extend past the front leg 0 of the receiving member 12 and terminate in a retaining member 66 that extends vertically therebetween. The retaining members 64, 66 cooperate with appliance receiving member 12 to retain an appliance, such as an electric iron, securely within the appliance receiving region 18.

The organizer 10 further includes a pair of left and right L-shaped frame support members 68, 70, each having a rearwardly extending horizontal bottom leg 72, 74, respectively, and a front vertical leg 76, 78 attached to and extending between top and bottom legs 40, 42 and 44, 46. Each horizontal bottom leg 72, 74 terminates in an offset portion 80, 81 to provide for pivotal attachment of a hanging member 82.

Two or more laterally spaced shelf members 83 connect to and extend between horizontal legs 72, 74 and bottom legs 24, 26 of member 12.

The vertical distance between left and right bottom legs 42, 46 of frame members 14, 16 and shelf members 83 permits the retaining members 64, 66 to securely engage the body of an iron I placed in storage region 18 without interfering with the electric cord of the iron. It should be noted that once an iron I is cradled within the appliance storage region 18, the upper protector portion 38 of appliance receiving member 12 spaces the iron I away from and the support S to prevent contact between a hot iron and the support or mounting surface.

The generally U-shaped hanging member 82 has a pair of spaced-apart J-shaped legs 84 defining support hooks 85. Each hook 85 is formed as a closed U-shaped loop and are connected together by a connecting link or portion 86 extending therebetween. Significantly, hanging member 82 as configured, accepts and securely holds ironing boards that have either Y-shaped legs L1 or T-shaped legs B2.

Figure 2:
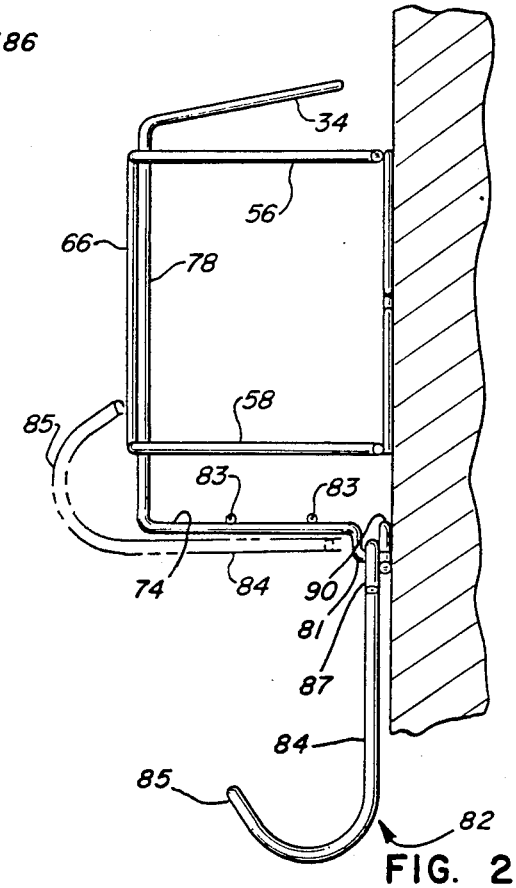
FIG. 2 is an elevational end view thereof illustrating the pivotal movement of the hanging member.
Figure 3:
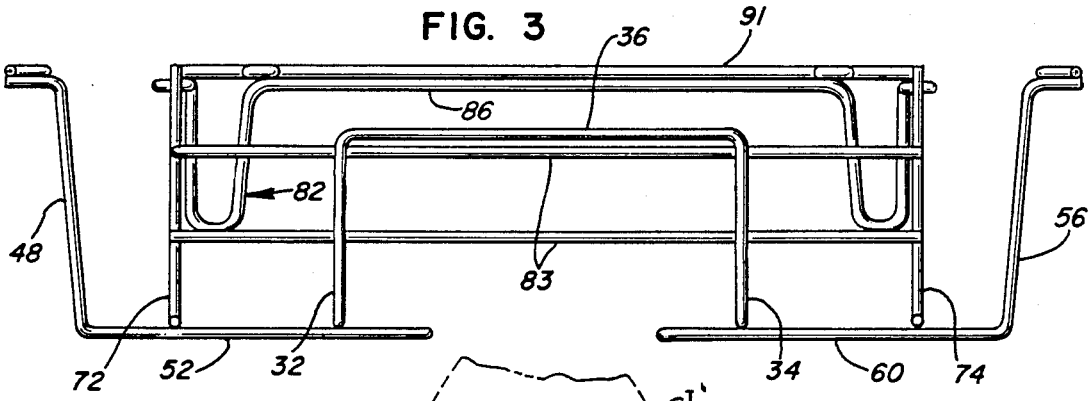
FIG. 3 is a top plan view of thereof.
Figure 4:
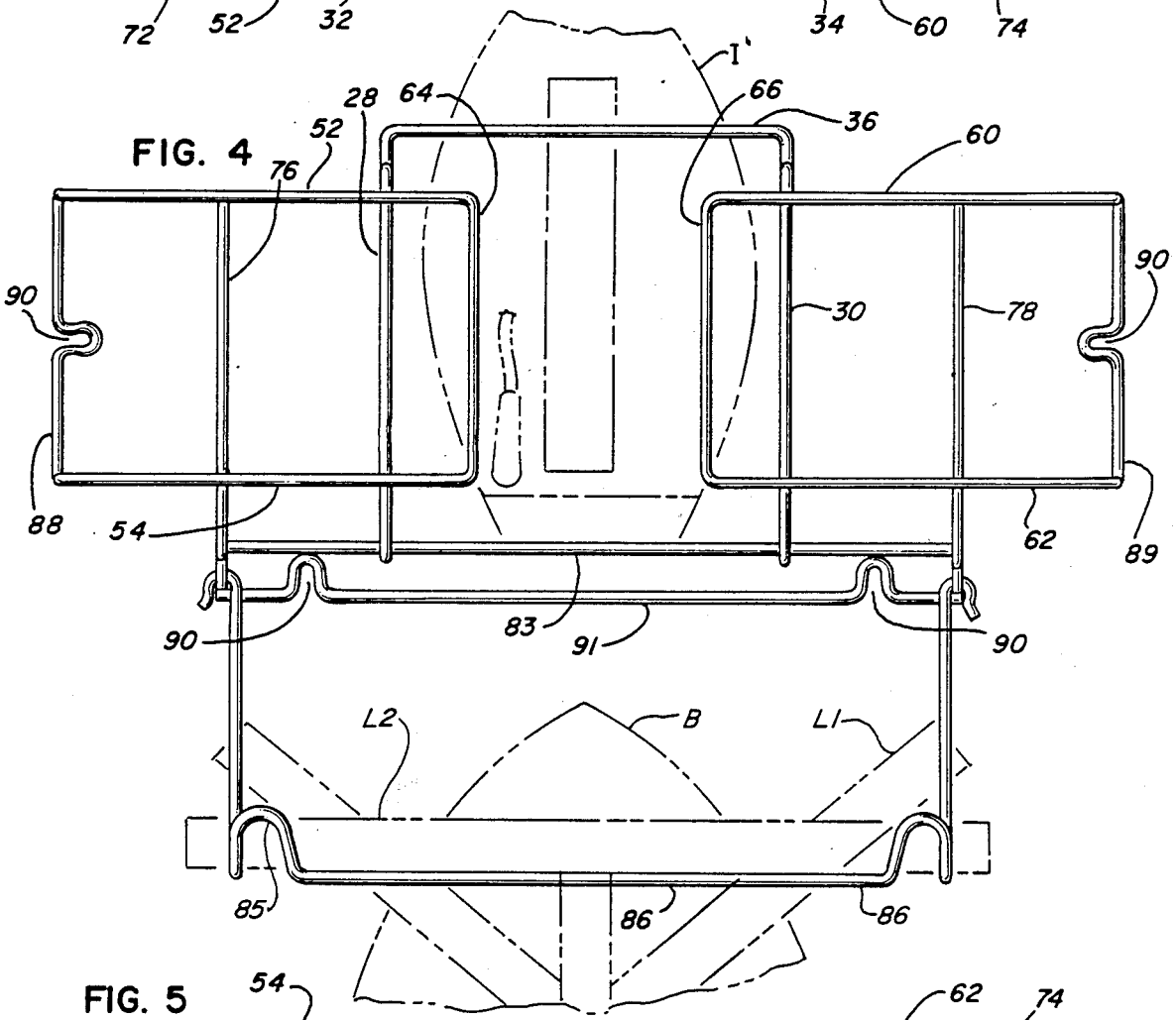
FIG. 4 is an elevational front view of thereof.
Figure 5:
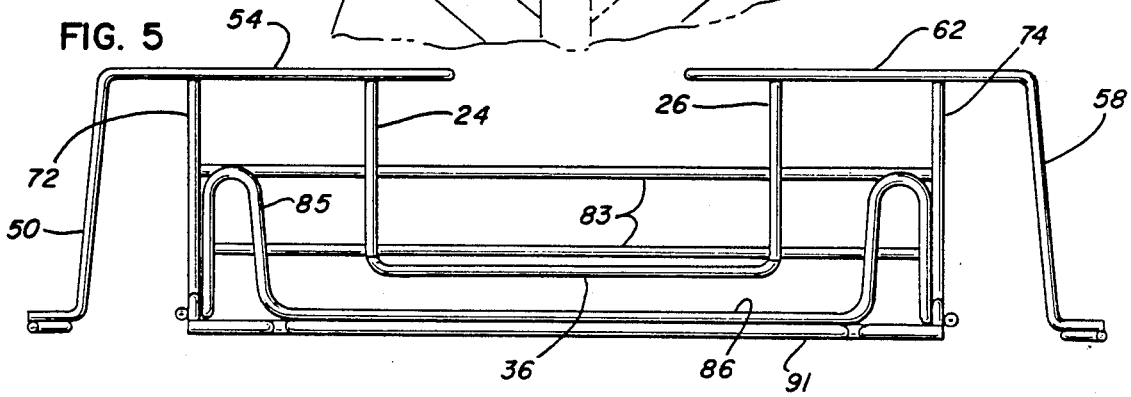
FIG. 5 is a bottom plan view of thereof.

As seen in the drawing, each of the J-shaped legs 84 of hanging member 82 has a hooked shaped termination 87 that resiliently engages offset portions 80, 81 of horizontal legs 72, 74 to secure hanging member 82 to organizer 10 and allow it to rotate into a nesting position as indicated in by shadow lines in FIG. 2. The pivotal feature of the hanging member 82 thereby substantially reduces the overall size of the organizer unit 10 to significantly facilitate shipping and storage.

The organizer 10 includes left and right vertical mounting members 88, 89 attached to the side frame members 14, 16. The mounting members 88, 89 include eyelets 90 adapted to receive suitable fasteners for securing the organizer device 10 to support S. An additional mounting member 91 is attached to and extends between horizontal legs 72, 74 of the frame support members 68, 70. Two eyelets 90 are provided in member 91 to receive a suitable fastener for attachment to the support S.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims, all such modifications as fall within the scope of the appended claims.

What is claimed is:

1. A storage device for household appliances and related items mountable on a support, comprising:

a frame assembly defining a generally upwardly opening appliance storage region and a pair of additional storage regions adjacent thereto;

hanger means depending from said frame assembly and configured to support an article hung therefrom of the type having a portion depending below said hanger means;

said hanger means comprising a pair of spaced-apart, forward opening hook means, each connected to said frame assembly, and means interconnecting said hook means for maintaining a substantially constant spacing therebetween, said interconnecting means being located to permit access by an article with such a depending portion to both of said hook means through said forward opening portion for support thereon.

2. A storage device as claimed in claim 1, wherein: said additional storage regions are located on opposite sides of said appliance storage region.

3. A storage device as claimed in claim 1, wherein: said hanger means is pivotable relative to said frame assembly between an article hanging position and a storage position adjacent to said frame assembly to facilitate shipment and storage of said storage device.

4. A storage device as claimed in claim 1, wherein: each of said hook means includes a generally elongated connecting portion and an article support portion, said interconnecting means terminating at each of said hook means at a point adjacent the juncture of said elongated connecting portion and said article support portion with said article support portion extending generally forwardly from said juncture to permit access to both of said hook means through the forward opening thereof of an article supportable on said hook means and having a portion disposed therebetween and depending therefrom.

5. A storage device as claimed in claim 4, wherein: said article support portions of each of said hook means is generally U-shaped, the closed end of each of said generally U-shaped article support portions being disposed at the forward end thereof, and the legs of each of said generally U-shaped article support portions extending rearwardly therefrom with the rear end of one of said legs being connected to said elongated connecting portion and the rear end of the other of said legs being connected to said interconnecting means.

6. A storage device as claimed in claim 1, wherein: each of said spaced-apart hook means is pivotally connected to said frame assembly, said hanger means being pivotable relative to said frame assembly between an article hanging position and a storage position adjacent to said frame assembly.

7. A storage device as claimed in claim 6, wherein: said hanger means is a unitary one piece structure.

8. A storage device as claimed in claim 2, wherein: said frame assembly includes a front wall portion, a pair of spaced-apart sidewall portions and a bottom shelf portion, said hanger means being pivotally connected to said frame assembly adjacent the rear edge thereof.

9. A storage device as claimed in claim 8, wherein: said hanger means is pivotally connected to said shelf portion to be positioned adjacent to a support on which said device is mounted.

10. A storage device as claimed in claim 1, including: protector means forming part of said frame assembly and at least partially defining said appliance storage region for maintaining an appliance stored in said appliance storage region, spaced away from and forwardly of the support to which such storage device is attached.

11. A storage device as claimed in claim 10, including:

retaining means forming part of said frame assembly and extending over the forward portion of said appliance storage region from opposite sides thereof, for retaining an appliance disposed therein between said retaining means and said protector means.

12. A storage device as claimed in claim 11, including:

shelf means forming part of said frame assembly and disposed below said retaining means and in the space between said retaining means and said protector means for supporting an appliance thereon when disposed in said appliance storage region.

13. A storage device as claimed in claim 12, wherein: said shelf means extend laterally beyond said appliance storage means and below said additional storage regions adjacent thereto.

14. A storage device for household appliances and related items mountable on a support comprising:

a centrally disposed appliance receiving member defining a generally upwardly opening appliance storage region;

said appliance receiving member comprised of a pair of generally U-shaped vertically extending horizontally spaced apart elongate members each having generally horizontal rearwardly extending bottom legs, generally vertical front legs and rearwardly extending upwardly tapered upper legs with the rear ends of said upper legs being spaced from said support and being interconnected by a protector leg engageable by an appliance disposed in said appliance storage region to maintain said appliance spaced from said support;

a pair of laterally extending side frame members each having a forward portion lying generally in the plane of the front legs of,said receiving member and rearwardly and outwardly extending side portions spaced from said receiving member to define additional storage areas therebetween; and shelf means connected to and extending between said bottom legs and spaced below the bottom edge of said side frame members for supporting an article disposed in said storage regions.

15. A storage device as claimed in claim 14, including:

hanger means depending from said storage device assembly and configured to support an article hung therefrom, said hanger means being pivotable relative to said storage device between an article hanging position and a storage position adjacent to said shelf means to facilitate shipment and storage of said storage device.

* * * * *